US007172146B2

(12) United States Patent
Schmitz et al.

(10) Patent No.: US 7,172,146 B2
(45) Date of Patent: Feb. 6, 2007

(54) GRINDING AND IMPELLER CLIP FOR A COAL PULVERIZER

(75) Inventors: William Schmitz, Clymer, NY (US); Craig A. Penterson, Sutton, MA (US); Daniel P. Smith, Spencer, MA (US)

(73) Assignee: Riley Power, Inc., Worcester, MA (US)

( * ) Notice: Subject to any disclaimer, the term of this patent is extended or adjusted under 35 U.S.C. 154(b) by 55 days.

(21) Appl. No.: 11/011,885

(22) Filed: Dec. 14, 2004

(65) Prior Publication Data

US 2006/0124792 A1 Jun. 15, 2006

(51) Int. Cl.
*B02C 13/20* (2006.01)
*B02C 13/00* (2006.01)
*B02C 13/28* (2006.01)

(52) U.S. Cl. ..... 241/188.2; 241/197; 241/300

(58) Field of Classification Search ..... 241/188.1, 241/188.2, 197, 300
See application file for complete search history.

(56) References Cited

U.S. PATENT DOCUMENTS

| | | | | |
|---|---|---|---|---|
| 1,628,609 | A | | 5/1927 | Newhouse |
| 2,625,332 | A | | 1/1953 | Rogers et al. |
| 2,628,038 | A | * | 2/1953 | Rogers et al. ..... 241/300 |
| 2,639,863 | A | * | 5/1953 | Rogers ..... 241/191 |
| 3,050,018 | A | | 8/1962 | Pearson |
| 3,092,337 | A | | 6/1963 | Patterson |
| 4,424,938 | A | | 1/1984 | Day |
| 4,485,975 | A | | 12/1984 | Eigner et al. |
| 4,919,795 | A | | 4/1990 | Fujii et al. |
| 5,025,930 | A | | 6/1991 | Barthelmess et al. |
| 5,289,978 | A | | 3/1994 | Lundquist |
| 5,348,272 | A | | 9/1994 | Lukstas et al. |
| 5,560,550 | A | | 10/1996 | Krawczyk |
| 5,938,045 | A | | 8/1999 | Makino et al. |
| 6,027,057 | A | | 2/2000 | Miles |
| 6,443,376 | B1 | | 9/2002 | Huang et al. |
| 6,644,479 | B1 | | 11/2003 | Kimmeyer et al. |
| 2003/0141396 | A1 | | 7/2003 | Whaley |

* cited by examiner

*Primary Examiner*—Faye Francis
(74) *Attorney, Agent, or Firm*—Edwards Angell Palmer & Dodge, LLP

(57) ABSTRACT

The present invention is directed to, among other things, a grinding and impeller clip for attaching to a wheel assembly mounted for rotational motion within a grinding chamber of a coal pulverizer, wherein the clip has an arcuate cross sectional profile and a protective layer on its upper surface.

20 Claims, 6 Drawing Sheets

FIG. 9
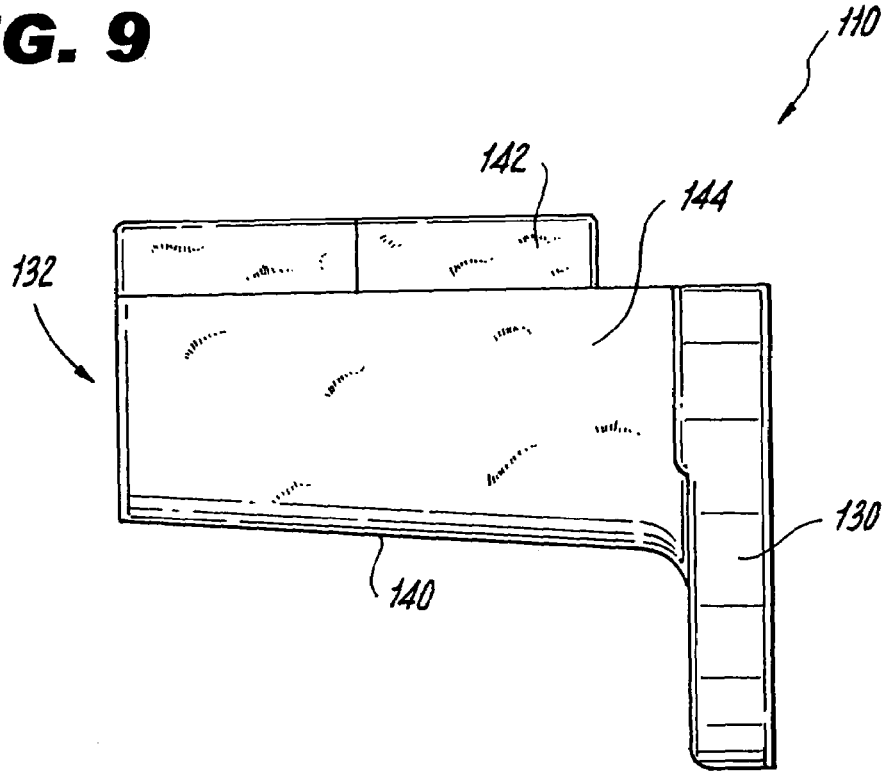
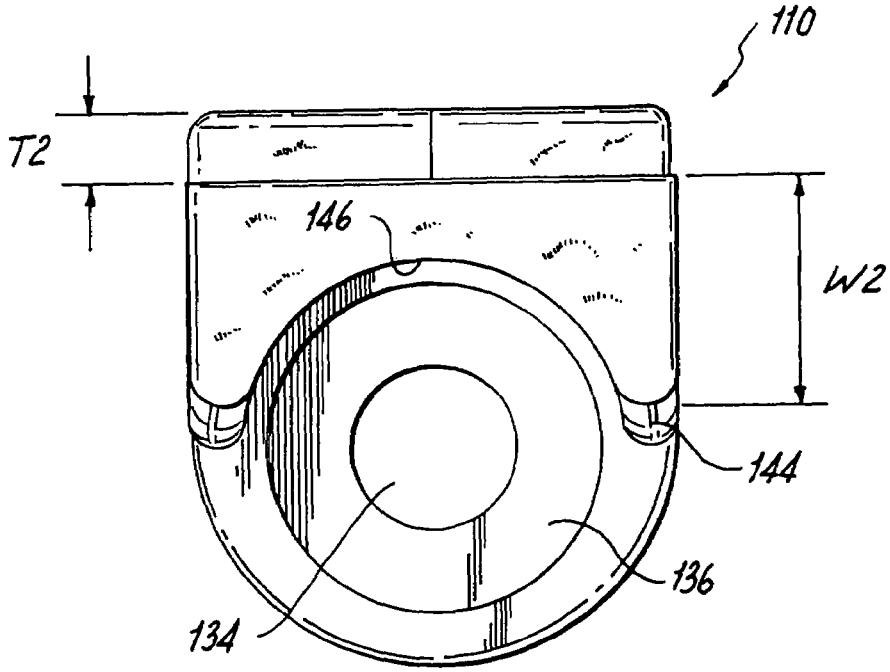
FIG. 10

GRINDING AND IMPELLER CLIP FOR A COAL PULVERIZER

BACKGROUND OF THE INVENTION

1. Field of the Invention

The present invention relates to a grinding process for a material size reduction process based on the particle size, and more particularly, it concerns an improved classifier assembly for a rotary coal pulverizer.

2. Background of the Related Art

In operations that use coal for fuel, finely-ground coal particles or "fines" are required for efficient operation, yielding higher combustion efficiency than stoker firing, as well as rapid response to load changes. Using coal fines for combustion also produces less nitrous oxide ($NO_X$) emissions and keeps oversized loss-on-ignition (LOI) unburned coal particles from contaminating the marketable ash byproduct of the combustion chamber. Thus, it is common practice to supply raw coal to a device, such as a pulverizer, that will reduce the size of the coal to particles within a desirable range prior to being used for combustion.

Many pulverizers employ systems and methods including one or more crushing and grinding stages for breaking up the raw coal. Coal particles are reduced by the repeated crushing actions of rolling or flailing elements to dust fine enough to become airborne in an air stream swept through the pulverizer. The dust particles are entrained in the air stream and carried out for combustion.

It should be readily apparent that the process of reducing solid coal to acceptably sized fines requires equipment of high strength and durability. Therefore, there exists a continuing need for crushing and grinding components which can reduce solid coal to acceptably sized fines in less time with greater efficiency, and in a manner which results in less wear and tear.

SUMMARY OF THE DISCLOSURE

The present invention improves upon and solves the problems associated with the prior art by providing, among other things, a grinding and impeller clip for fastening on a wheel assembly mounted on a center shaft of a material size reducing system, wherein the center shaft defines an axis of rotation and is configured for rotational motion within a process chamber of the material size reducing system.

In particular, the grinding and impeller clip includes a clip body defining a base portion and an elongated wing portion. The base portion is configured to facilitate the engagement of the clip body to the wheel assembly. The elongated wing portion extends from the base portion and includes upper and lower surfaces, wherein the upper surface includes a protective outer layer of a material having greater resistance to damage from the material size reducing system than the wing portion. Preferably, the protective layer includes protective tiles fabricated of tungsten carbide.

To facilitate the engagement of the clip body to the wheel assembly, in an exemplary embodiment, the base portion is substantially ring-shaped and defines a hole configured for receiving a fastening assembly to secure the clip body to the wheel assembly. The base portion of the clip can also include a recessed rim around the hole for accommodating a fastening assembly, such as nuts or the heads of bolts, nails or screws, or the like.

Preferably, the cross sectional area of the elongated wing portion near its edges is greater than the cross sectional area at its center, and more preferably, the elongated wing portion has a substantially arcuate cross sectional profile. In addition, the clip body is preferably constructed of an alloy, such as Ni-Hard, and formed by ductile forging.

The present invention is also directed to a coal pulverizer having a grinding chamber and a center shaft defining an axis of rotation and configured for rotational motion within the grinding chamber, wherein the coal pulverizer includes a grinding and impeller clip for attaching to a wheel assembly mounted on the center shaft.

The clip, as discussed above, has a base portion and an elongated wing portion. The base portion is configured to facilitate the engagement of the clip body to the wheel assembly. The wing portion extends from the base portion and includes upper and lower surfaces. The upper surface includes a protective outer layer of a material having greater resistance to damage from impact with coal particles than the wing portion.

In addition, the present invention is directed to a wheel assembly mounted on a center shaft of a rotary coal pulverizer which includes a grinding and impeller clip. The clip has a body defined by a base portion and an elongated wing portion. The base portion is operatively associated with the wheel so that the wing portion projects substantially perpendicularly from the plane of the wheel assembly. The wing portion includes a protective upper layer made of a material having greater resistance to damage from repeated impact with the coal particles than the material used to construct the wing portion. Preferably, the wing portion of the clip has a substantially arcuate cross sectional profile.

These and other aspects of the present invention will become more readily apparent to those having ordinary skill in the art from the following detailed description of the invention taken in conjunction with the drawings.

BRIEF DESCRIPTION OF THE FIGS.

So that those having ordinary skill in the art to which the present invention pertains will more readily understand how to make and use the present invention, an embodiment thereof will be described in detail with reference to the drawings, wherein:

FIG. 9 is a side view of the clip shown in FIG. 7 constructed in accordance with the present invention;

FIG. 10 is a front view of the clip shown in FIG. 7 constructed in accordance with the present invention, illustrating the cross sectional thickness of the elongated wing portion adjacent its edge and the thickness of the protective tile layer;

DETAILED DESCRIPTION OF THE PREFERRED EMBODIMENTS

Reference is now made to the FIGS. and accompanying detailed description which have been provided to illustrate exemplary embodiments of the present invention, but are not intended to limit the scope of embodiments of the present invention. Although a particular type of rotary coal pulverizer is shown in the FIGS. and discussed herein, it should be readily apparent that a device or system constructed in accordance with the present invention can be employed in a variety of other coal pulverizers, or other applications that do not involve coal as the raw material. In other words, the specific material and size reduction process is not vital to gaining the benefits associated with using a system constructed in accordance with the present invention.

Figure 1:
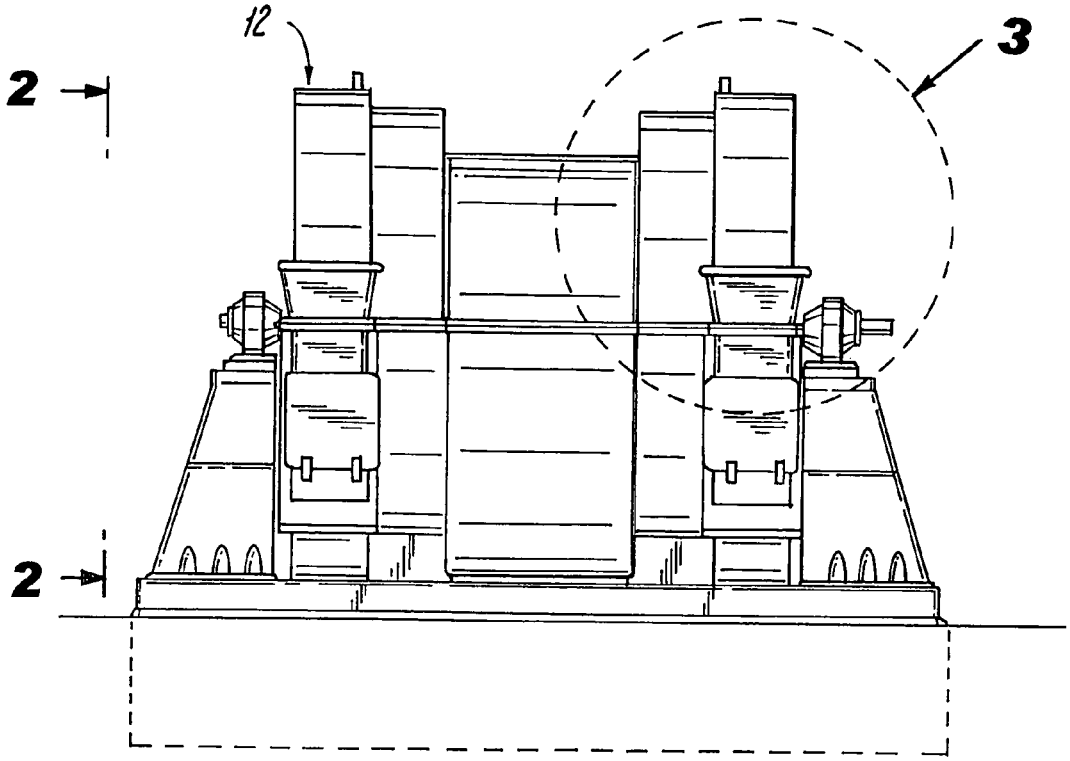
FIG. 1 is front view of an exemplary rotary coal pulverizer (duplex model) which can employ a classifier assembly constructed in accordance with the present invention therein mounted on the center shaft at two locations.
Figure 2:
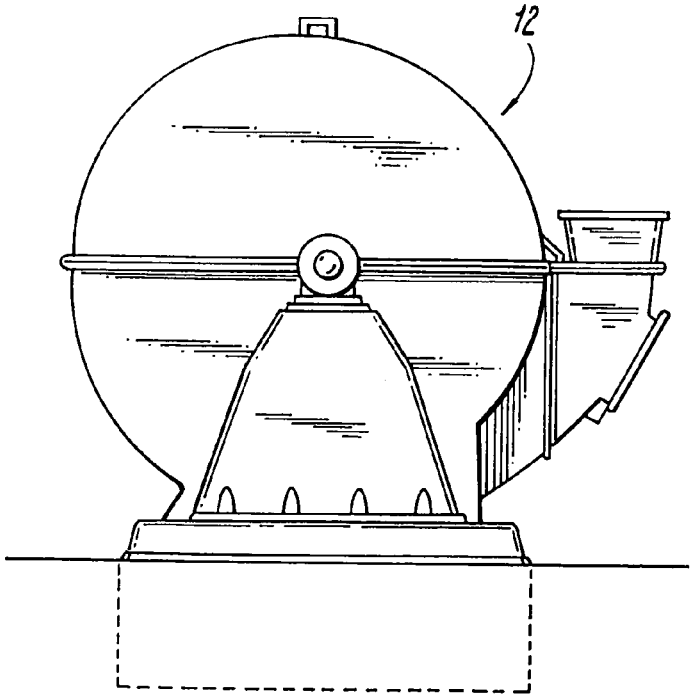
FIG. 2 is a side view of the rotary coal pulverizer of FIG. 1, illustrating the output from the fan section of the pulverizer.

FIGS. 1 and 2 illustrate the general location of a presently preferred embodiment of a grinding and impeller clip (hereinafter also referred to as a "clip") constructed in accordance with the present invention and employed in an exemplary rotary coal pulverizer 12, from the exterior of pulverizer 12. Pulverizer 12 is known as a horizontal type high speed coal mill and is closely based on a duplex model ATRITA® Pulverizer sold commercially by Babcock Power Inc. However, this should not be interpreted as limiting the present invention in any way, as many types of pulverizing devices employ similar elements and are suitable for use with the present invention.

The duplex model is essentially two single models side by side. It should be readily apparent that a clip constructed in accordance with the present invention may also be disposed in a single model. For purposes of ease and convenience in describing the features of the present invention, only a single side of the duplex model is discussed herein.

Figure 3:
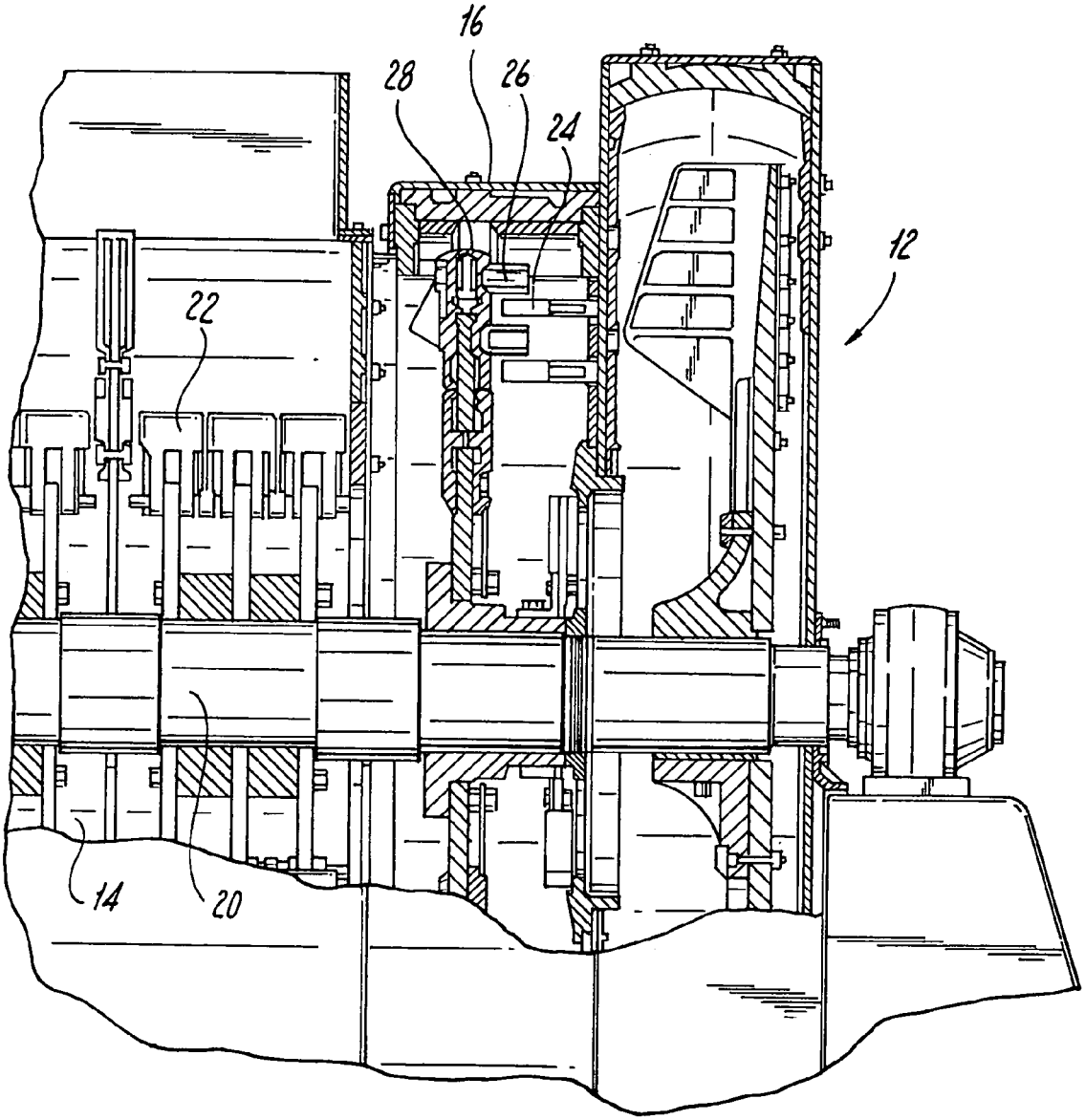
FIG. 3 (Prior Art)
FIG. 3 is an enlarged localized partial cross-sectional view of a portion of the exemplary rotary coal pulverizer of FIG. 1, illustrating a prior art grinding and impeller clip positioned on the wheel assembly in the grinding section.

As can be seen in FIG. 3, pulverizer 12 consists essentially of a crusher-dryer section 14, a grinding section 16 and a fan section 18. A center shaft 20 extends through the pulverizer 12 and defines an axis of rotation. Thus, terms used herein, such as "radially outer" and "radially inner," therefore refer to the relative distance in a perpendicular direction from the axis defined by center shaft 20, while "axially inner" and "axially outer" refer to the distance along or parallel to the axis defined by center shaft 20, wherein the "axially innermost" section in pulverizer 12 is crusher-dryer section 14.

Raw coal and primary air enter the crusher-dryer section 14. Swing hammers 22 mounted on and driven by center shaft 20, along with impact liners (not shown), operate to crush the coal against a grid (not shown). High temperature primary air is used to flash dry any surface moisture on the coal, which helps minimize the effect of moisture on coal capacity, coal fineness, and power consumption, among other things. As the high-temperature primary air evaporates moisture from the coal, the temperature of the coal-air mixture is reduced, which significantly reduces the risk of fires within the pulverizer.

Figure 4:
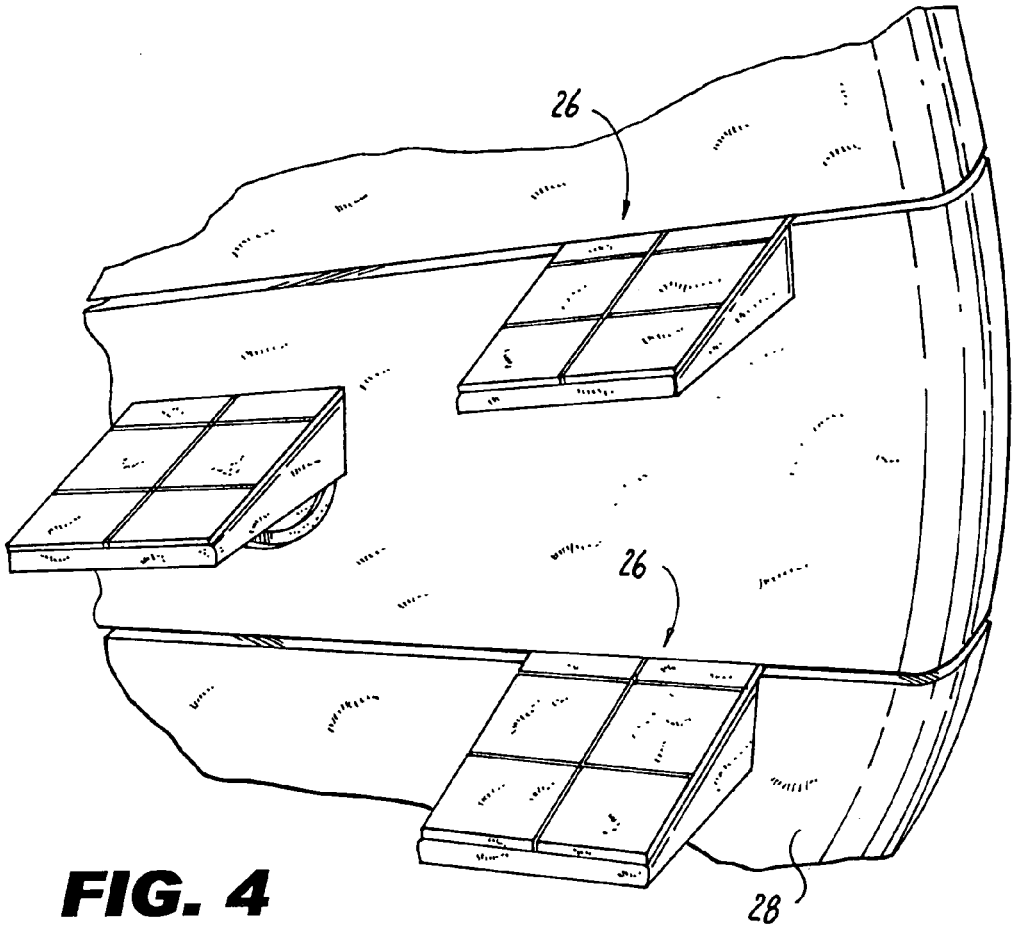
FIG. 4 (Prior Art)
FIG. 4 is a perspective partial view illustrating the arrangement of prior art grinding and impeller clips on the wheel assembly.

When coal passes through the grid of the crusher-dryer section 14, it enters the axially outer adjacent grinding section 16. The major grinding components in grinding section 16 include stationary pegs 24 and prior art clips 26 disposed on a rotating disc or wheel assembly 28. As shown in FIG. 4, clips 26 are generally arranged in concentric circles and preferably staggered along radii. Clips 26 extend substantially perpendicularly with respect to the plane of wheel 28.

Wheel 28 is mounted on and driven by center shaft 20, preferably at a relatively high rate of speed. The turbulent flow and impact momentum on particles, caused by the movement of clips 26 and stationary pegs 24, create a particle to particle attrition which further reduces the size of the coal particles received from crusher-dryer section 14.

Figure 5:
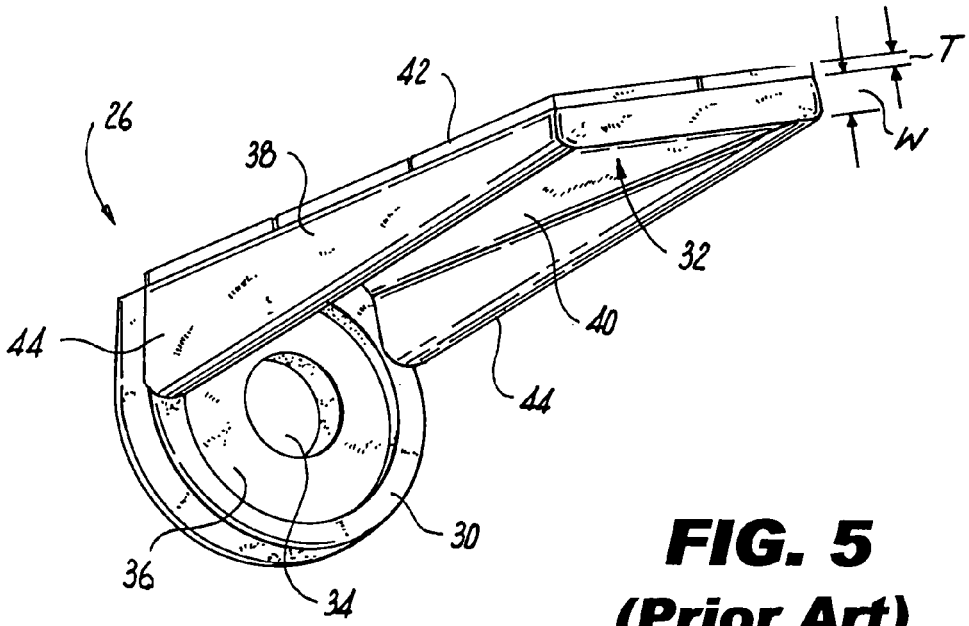
FIG. 5 (Prior Art)
FIG. 5 is a perspective view of a prior art grinding and impeller clip illustrating the thickness of the prior art elongated wing portion and prior art protective tile layer on the upper surface of the elongated wing portion.
Figure 6:
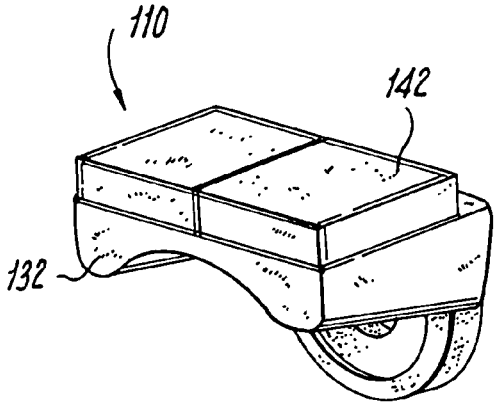
FIGS. 6–8 are perspective cross sectional views of grinding and impeller clips constructed in accordance with the present invention, illustrating the differences in the cross sectional shape between the prior art clip and clips constructed in accordance with the present invention.
Figure 7:
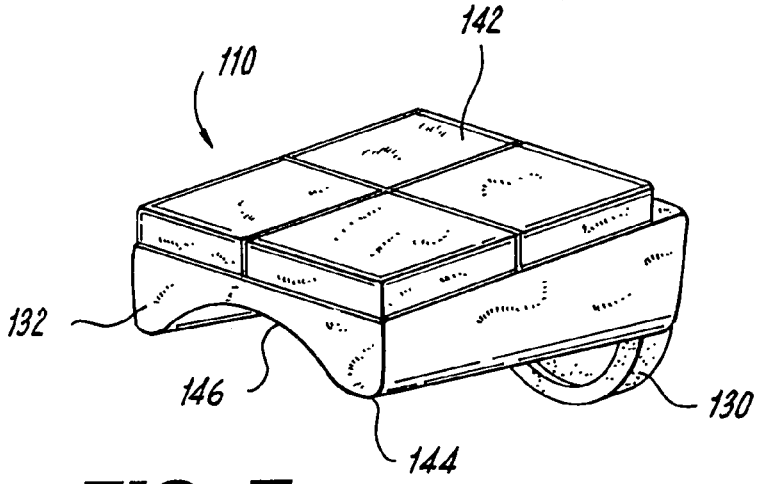
Figure 8:
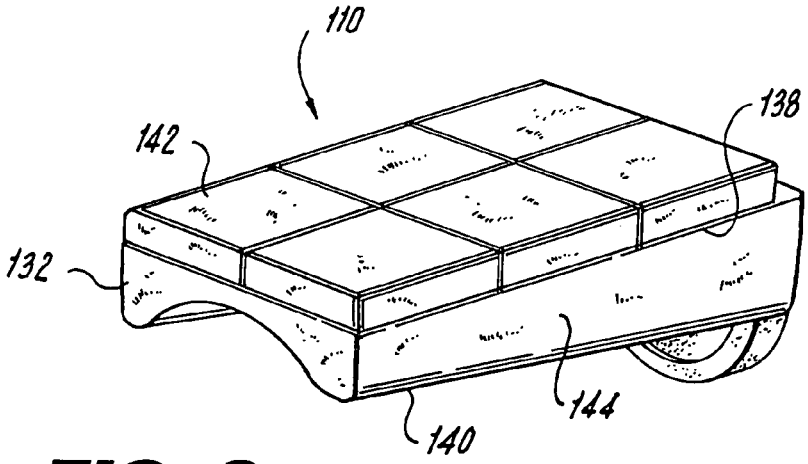
Figure 11:
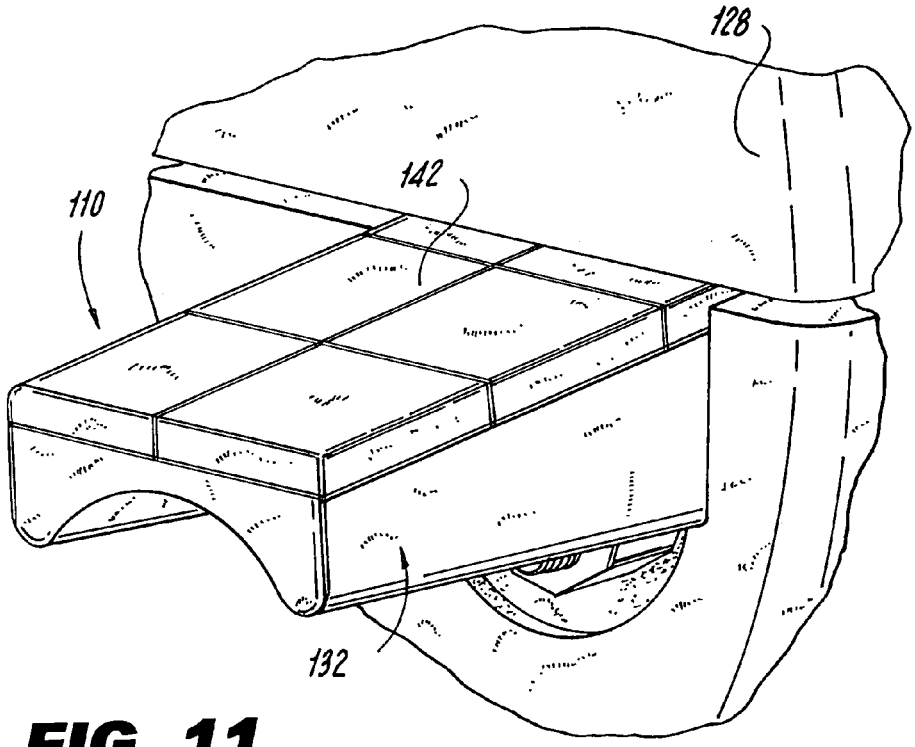
FIG. 11 is a partial perspective view of a grinding and impeller clip of the present invention secured to a wheel assembly in a rotary coal pulverizer constructed in accordance with the present invention.
Figure 12:
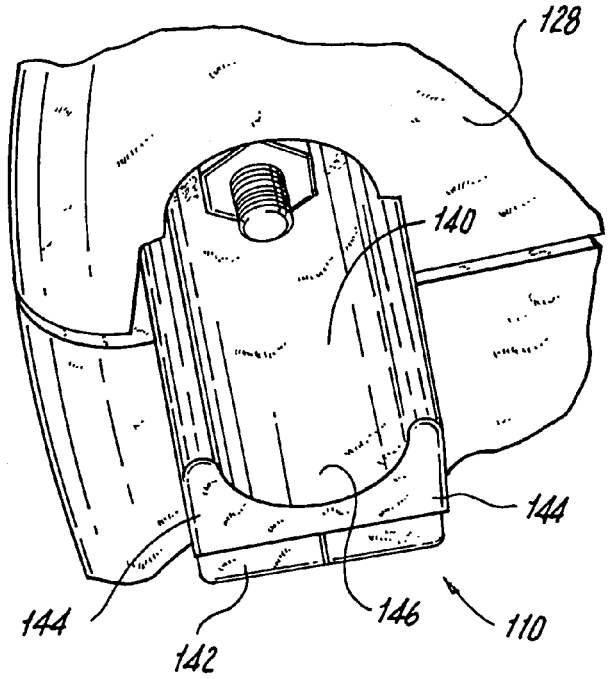
FIG. 12 is a partial perspective view of the clip shown in FIG. 11, illustrating the lower surface of the clip and an exemplary fastening assembly for securing the clip to the wheel assembly.

As can also be seen in FIG. 5, prior art clips 26 were generally L-shaped, consisting of a base 30 and an elongated wing 32 extending therefrom. Base 30 included a hole 34 that provided a location for facilitating the engagement of clip 26 to wheel assembly 28, such as by a corresponding bolt and nut assembly. Base 30 included a recess 36 sufficiently sized for accommodating a nut secured to a bolt passing through hole 34, and for providing further support thereto.

Elongated wing 32 included an upper surface 38 and lower surface 40. A layer of tiles 42 was disposed on upper surface 38 of wing 32. The thickness T of tiles 42 is approximately 3/16 in. (4.76 mm). The thickness W of wing 32 is approximately 5/16 in (7.94 mm). Wing 32 is further reinforced by tapered gusset supports 44 adjacent each longitudinal edge of lower surface 40 and connected with the base 30.

In contrast, FIGS. 6–12 illustrate grinding and impeller clips constructed in accordance with the present invention. The clips depicted in FIGS. 6–8 include elongated wings of differing longitudinal length, but are otherwise constructed in accordance with the present invention. Clips of different sizes can be constructed in accordance with the present invention and used in pulverizers, such as the pulverizer shown herein. For purposes of discussion, the clips depicted in FIGS. 6–7 will be considered as illustrating cross sectional views of the clip shown in FIG. 8.

Clip 110 is generally L-shaped with an elongated wing portion 132 extending from a base portion 130. Base 130 is configured to facilitate attachment of clip 110 to a wheel assembly, such as wheel 128. In this embodiment, hole 134 in base 130 renders base 130 ring-shaped, and capable of being secured to a wheel by a nut and bolt assembly. Recess 136 surrounds hole 134 to help accommodate a fastening assembly. Wing 132 includes a protective layer of tiles 142 on upper surface 138 which shields wing 132 from impact with the coal during pulverizer operation.

One of the main problems found with prior art clip 26 is that wing 32 wore out at the same rate as tiles 42. Wing 132 is preferably reinforced by added material and configured in shape which protects the structural integrity of clip 110 against impact during the material reduction process. In this embodiment, wing 132 has thicker cross sections at longitudinal edges 144 of wing 132, and defines an arcuate or arch-like latitudinal cross section, particularly latitudinally along the lower surface 140. The thickness W2 of wing portion at edges 144 is preferably at least about twice the thickness in the latitudinal midpoint 146 between edges 144 of the lower surface 140 of wing 132. The thickness T2 of tiles 142 is preferably approximately ⅜ in. (9.5 mm).

Clip 110 and tiles 142 can be constructed of any materials capable of withstanding the punishing wear and tear of being used in a pulverizer, such as pulverizer 12. Prior art clip 26 was made of solid Ni-Hard (i.e., cast iron to which nickel has been added to make it resist abrasion) which proved to be very brittle and caused breakage that resulted in system failure. Tiles 42 of prior art clip 26 were made of tungsten carbide.

Clip 110 is preferably constructed by ductile forging to eliminate the brittleness problem discussed above, among other things. Tiles 142 are preferably constructed of tungsten carbide. Tiles 142 increase wear life and the increased cross section of wing 132, particularly at its base, or convergence with fastening end 130, reduces wear of clip 110 significantly from that which has been experienced with clip 26.

Although exemplary and preferred aspects and embodiments of the present invention have been described with a full set of features, it is to be understood that the disclosed system and method may be practiced successfully without the incorporation of each of those features. For example, many industries include applications that utilize raw materials that are first broken up into relatively small sized particles. Accordingly, the raw materials are fed into devices that employ one or more physical processes to reduce the size of the raw material prior to their use. A grinding and impeller clip constructed according to the present invention can be utilized for such purposes. Thus, it is to be further understood that modifications and variations may be utilized without departure from the spirit and scope of this inventive system and method, as those skilled in the art will readily understand. Such modifications and variations are considered to be within the purview and scope of the appended claims and their equivalents.

What is claimed is:

1. A grinding and impeller clip for attaching to a wheel assembly mounted on a center shaft defining an axis of rotation and configured for rotational motion within a process chamber of a material size reducing system, the clip comprising:

a) a clip body defining a base portion, the base portion being configured to facilitate the engagement of the clip body to the wheel assembly; and b) an elongated wing portion, the wing portion extending outwardly from the base portion along a first axis and defining a length generally parallel to the first axis, the wing portion including upper and lower surfaces, wherein the upper surface includes a protective outer layer of a material having greater resistance to damage from the material size reducing system than another portion of the wing portion, wherein the cross section of the wing generally perpendicular to the first axis gradually reduces from each outer edge of the cross section toward a center of the cross section along the lower surface along a majority of the length of the wing portion.

2. A grinding and impeller clip as recited in claim 1, wherein the base portion is substantially ring-shaped and defines a hole configured for receiving a fastening assembly to facilitate the secure engagement of the clip body to the wheel assembly.

3. A grinding and impeller clip as recited in claim 2, wherein the base portion further comprises a recessed rim surrounding the hole for accommodating the fastening assembly therein.

4. A grinding and impeller clip as recited in claim 1, wherein the protective layer includes protective tiles.

5. The grinding and impeller clip of claim 4, wherein the tiles are about three eights of an inch thick.

6. A grinding and impeller clip as recited in claim 1, wherein the protective layer includes protective tiles fabricated of tungsten carbide.

7. A grinding and impeller clip as recited in claim 1, wherein the elongated wing portion has a substantially arcuate cross section.

8. A grinding and impeller clip as recited in claim 1, wherein the clip body is constructed of a Ni-Hard.

9. A grinding and impeller clip as recited in claim 8, wherein the clip body is formed by ductile forging.

10. A coal pulverizer having a grinding chamber and a center shaft defining an axis of rotation and configured for rotational motion within the grinding chamber, the coal pulverizer including a grinding and impeller clip for attaching to a wheel assembly mounted on the center shaft, the clip comprising:

a) a clip body defining a base portion, the base portion being configured to facilitate the engagement of the clip body to the wheel assembly; and b) an elongated wing portion, the wing portion extending outwardly from the base portion along a first axis and defining a length generally parallel to the first axis, the wing portion including upper and lower surfaces, wherein the upper surface includes a protective outer layer of a material having greater resistance to damage from impact with coal particles than another portion of the wing portion, wherein the cross section of the wing generally perpendicular to the first axis gradually reduces from each outer edge of the cross section toward a center of the cross section along the lower surface along a majority of the length of the wing portion.

11. A coal pulverizer as recited in claim 10, wherein the base portion of the clip body is substantially ring-shaped and defines a hole configured for receiving a fastening assembly to facilitate the secure engagement of the clip body to the wheel assembly.

12. A coal pulverizer as recited in claim 11, wherein the base portion further comprises a recessed rim surrounding the hole for accommodating the fastening assembly therein.

13. A coal pulverizer as recited in claim 10, wherein the protective layer includes protective tiles.

14. The grinding and impeller clip of claim 13, wherein the tiles are about three eights of an inch thick.

15. A coal pulverizer as recited in claim 10, wherein the protective layer includes protective tiles fabricated of tungsten carbide.

16. A coal pulverizer as recited in claim 10, wherein the elongated wing portion has a substantially arcuate cross section.

17. A coal pulverizer as recited in claim 10, wherein the clip body is constructed of a Ni-Hard.

18. A coal pulverizer as recited in claim 17, wherein the clip body is formed by ductile forging.

19. A wheel assembly mounted on a center shaft of a rotary coal pulverizer, the wheel assembly including a grinding and impeller clip comprising:

a) a clip body defining a base portion and an elongated wing portion, wherein the base portion is operatively associated with the wheel so that the wing portion outwardly projects substantially perpendicularly from the plane of the wheel assembly along the first axis, and the wing portion defines a length generally parallel to the first axis and includes a protective upper layer made of a material having greater resistance to damage from repeated impact with the coal particles than another portion of the wing portion, wherein the cross section of the wing generally perpendicular to the first axis gradually reduces from each outer edge of the cross section toward a center of the cross section along a lower surface along a majority of the length of the wing portion.

20. A wheel assembly as recited in claim 19, wherein the wing portion of the clip has a substantially arcuate cross sectional profile.

* * * * *